US006604254B1

(12) United States Patent
Powell

(10) Patent No.: US 6,604,254 B1
(45) Date of Patent: Aug. 12, 2003

(54) POOL CLEANING DEVICE

(76) Inventor: Robert M. Powell, 1720 Walnut St., Flatwoods, KY (US) 41139

( * ) Notice: Subject to any disclaimer, the term of this patent is extended or adjusted under 35 U.S.C. 154(b) by 57 days.

(21) Appl. No.: 09/922,294

(22) Filed: Aug. 3, 2001

(51) Int. Cl.[7] ..... A47L 11/00; E04H 4/16

(52) U.S. Cl. ..... 15/50.2; 15/1.7; 15/98; 15/160; 4/496

(58) Field of Search ..... 15/1.7, 50.2, 52.2, 15/98, 160, 210.1, 104.066, 246.5; 401/48, 203, 204, 205; 4/496

(56) References Cited

U.S. PATENT DOCUMENTS 3,268,933 A * 8/1966 Marantette et al. ..... 15/1.7
4,429,429 A 2/1984 Altschul
4,733,427 A 3/1988 Conrad
4,781,827 A * 11/1988 Shields ..... 210/169
5,365,626 A 11/1994 Santi
5,634,232 A 6/1997 Brenneman
D387,208 S 12/1997 Collett
5,709,793 A 1/1998 Kisner
6,421,869 B1 * 7/2002 Olsson ..... 15/50.1

* cited by examiner

*Primary Examiner*—Robert J. Warden, Sr.
*Assistant Examiner*—Shay L Balsis

(57) ABSTRACT

A pool cleaning device includes a housing assembly that has a base portion. The foot portion is for resting on a deck of a pool. A handle member slidably extends through the base portion of the housing assembly. The handle is to be gripped by hands of a user. The handle member is linearly oscillatable along an axis of the handle member. A head assembly is coupled to the handle member. The head assembly is positioned below the housing assembly such that the head assembly engages the walls of the pool. The head assembly is for facilitating cleaning of the walls of the pool when the handle member is oscillated along the axis of the handle member.

22 Claims, 4 Drawing Sheets

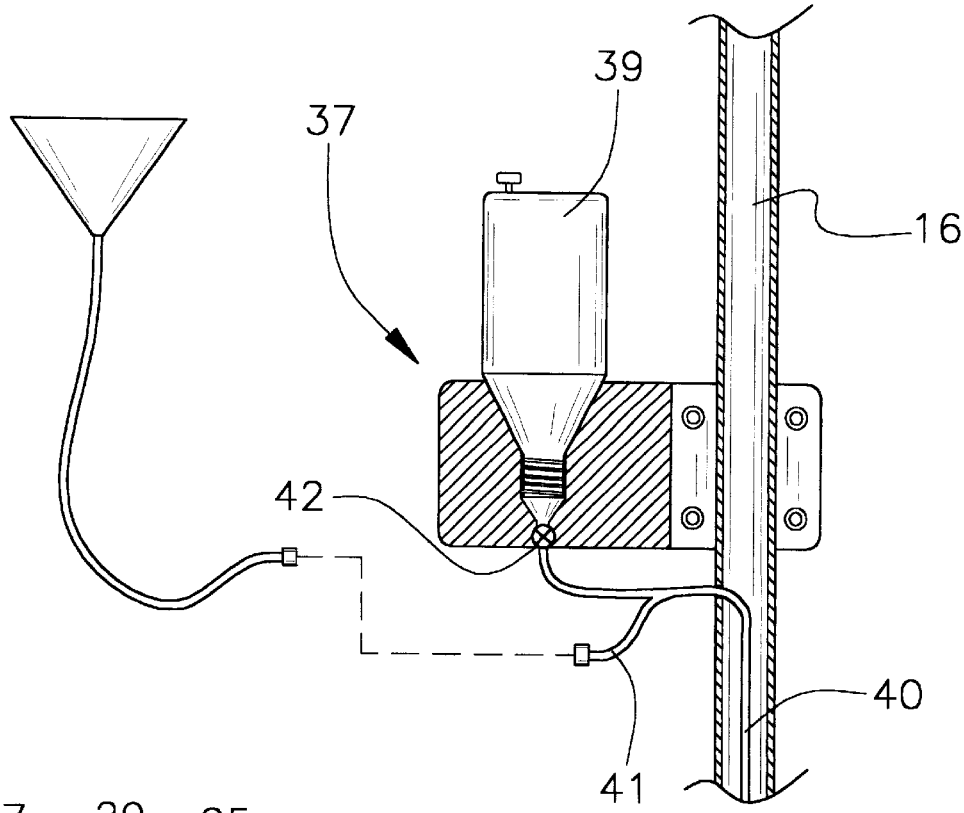
FIG. 5
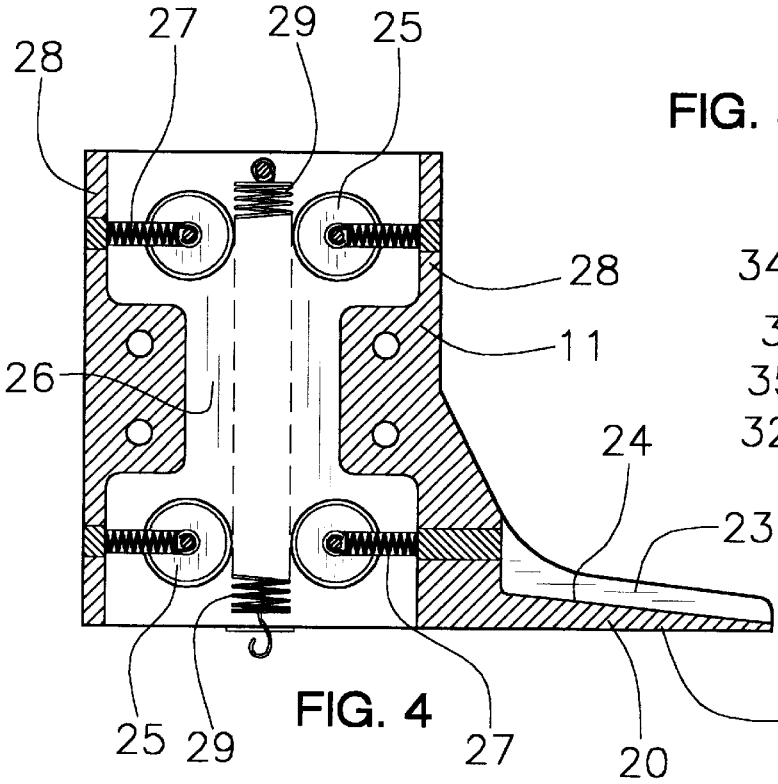
FIG. 4
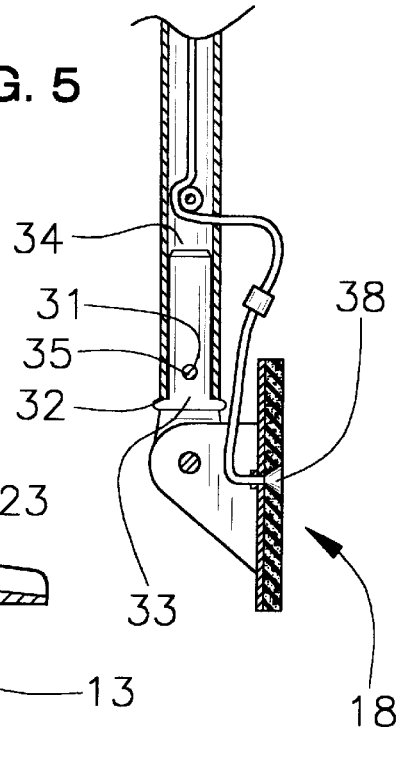

POOL CLEANING DEVICE

BACKGROUND OF THE INVENTION

1. Field of the Invention

The present invention relates to pool cleaning devices and more particularly pertains to a new pool cleaning device for allowing a user to easily apply clean solution to a side of the pool at the water line and scrub off the liner above the water line.

2. Description of the Prior Art

The use of pool cleaning devices is known in the prior art. More specifically, pool cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,365,626; U.S. Pat. No. 5,634,232; U.S. Pat. No. 5,709,793; U.S. Pat. No. 4,733,427; U.S. Pat. No. 4,429,429; and U.S. Pat. No. Des. 387,208.

While these devices fulfill their respective, particular objectives and requirements, the aforementioned patents do not disclose a new pool cleaning device. The inventive device includes a housing assembly that has a base portion. The foot portion is adapted for resting on a deck of a pool. A handle member slidably extends through the base portion of the housing assembly. The handle is adapted to be gripped by hands of a user. The handle member is linearly oscillatable along an axis of the handle member. A head assembly is coupled to the handle member. The head assembly is positioned below the housing assembly such that the head assembly engages the walls of the pool. The head assembly is adapted for facilitating cleaning of the walls of the pool when the handle member is oscillated along the axis of the handle member.

In these respects, the pool cleaning device according to the present invention substantially departs from the conventional concepts and designs of the prior art, and in so doing provides an apparatus primarily developed for the purpose of allowing a user to easily apply clean solution to a side of the pool at the water line and scrub off the liner above the water line.

SUMMARY OF THE INVENTION

In view of the foregoing disadvantages inherent in the known types of pool cleaning devices now present in the prior art, the present invention provides a new pool cleaning device construction wherein the same can be utilized for allowing a user to easily apply clean solution to a side of the pool at the water line and scrub off the liner above the water line.

The general purpose of the present invention, which will be described subsequently in greater detail, is to provide a new pool cleaning device apparatus and method which has many of the advantages of the pool cleaning devices mentioned heretofore and many novel features that result in a new pool cleaning device which is not anticipated, rendered obvious, suggested, or even implied by any of the prior art pool cleaning devices, either alone or in any combination thereof.

To attain this, the present invention generally comprises a housing assembly that has a base portion. The foot portion is adapted for resting on a deck of a pool. A handle member slidably extends through the base portion of the housing assembly. The handle is adapted to be gripped by hands of a user. The handle member is linearly oscillatable along an axis of the handle member. A head assembly is coupled to the handle member. The head assembly is positioned below the housing assembly such that the head assembly engages the walls of the pool. The head assembly is adapted for facilitating cleaning of the walls of the pool when the handle member is oscillated along the axis of the handle member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool cleaning device apparatus and method which has many of the advantages of the pool cleaning devices mentioned heretofore and many novel features that result in a new pool cleaning device which is not anticipated, rendered obvious, suggested, or even implied by any of the prior art pool cleaning devices, either alone or in any combination thereof.

It is another object of the present invention to provide a new pool cleaning device, which may be easily and efficiently manufactured and marketed.

It is a further object of the present invention to provide a new pool cleaning device, which is of a durable and reliable construction.

An even further object of the present invention is to provide a new pool cleaning device which is susceptible of a low cost of manufacture with regard to both materials and labor, and which accordingly is then susceptible of low prices of sale to the consuming public, thereby making such pool cleaning device economically available to the buying public.

Still yet another object of the present invention is to provide a new pool cleaning device, which provides in the apparatuses and methods of the prior art some of the advantages thereof, while simultaneously overcoming some of the disadvantages normally associated therewith.

Still another object of the present invention is to provide a new pool cleaning device for allowing a user to easily apply clean solution to a side of the pool at the water line and scrub off the liner above the water line.

Yet another object of the present invention is to provide a new pool cleaning device, which includes a housing assembly that has a base portion. The foot portion is adapted for resting on a deck of a pool. A handle member slidably extends through the base portion of the housing assembly. The handle is adapted to be gripped by hands of a user. The handle member is linearly oscillatable along an axis of the handle member. A head assembly is coupled to the handle member. The head assembly is positioned below the housing assembly such that the head assembly engages the walls of the pool. The head assembly is adapted for facilitating cleaning of the walls of the pool when the handle member is oscillated along the axis of the handle member.

Still yet another object of the present invention is to provide a new pool cleaning device that allow a user to remove calcium, grime, or algae, from a pool wall without needing to enter the pool, kneel over the side of the pool, or empty the pool water.

Even still another object of the present invention is to provide a new pool cleaning device that save the user time when cleaning the pool, allowing the user more time to enjoy the pool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross-sectional view of the present invention.

FIG. 5 is a cross-sectional view of the present invention.

DESCRIPTION OF THE PREFERRED EMBODIMENT

Figure 1:
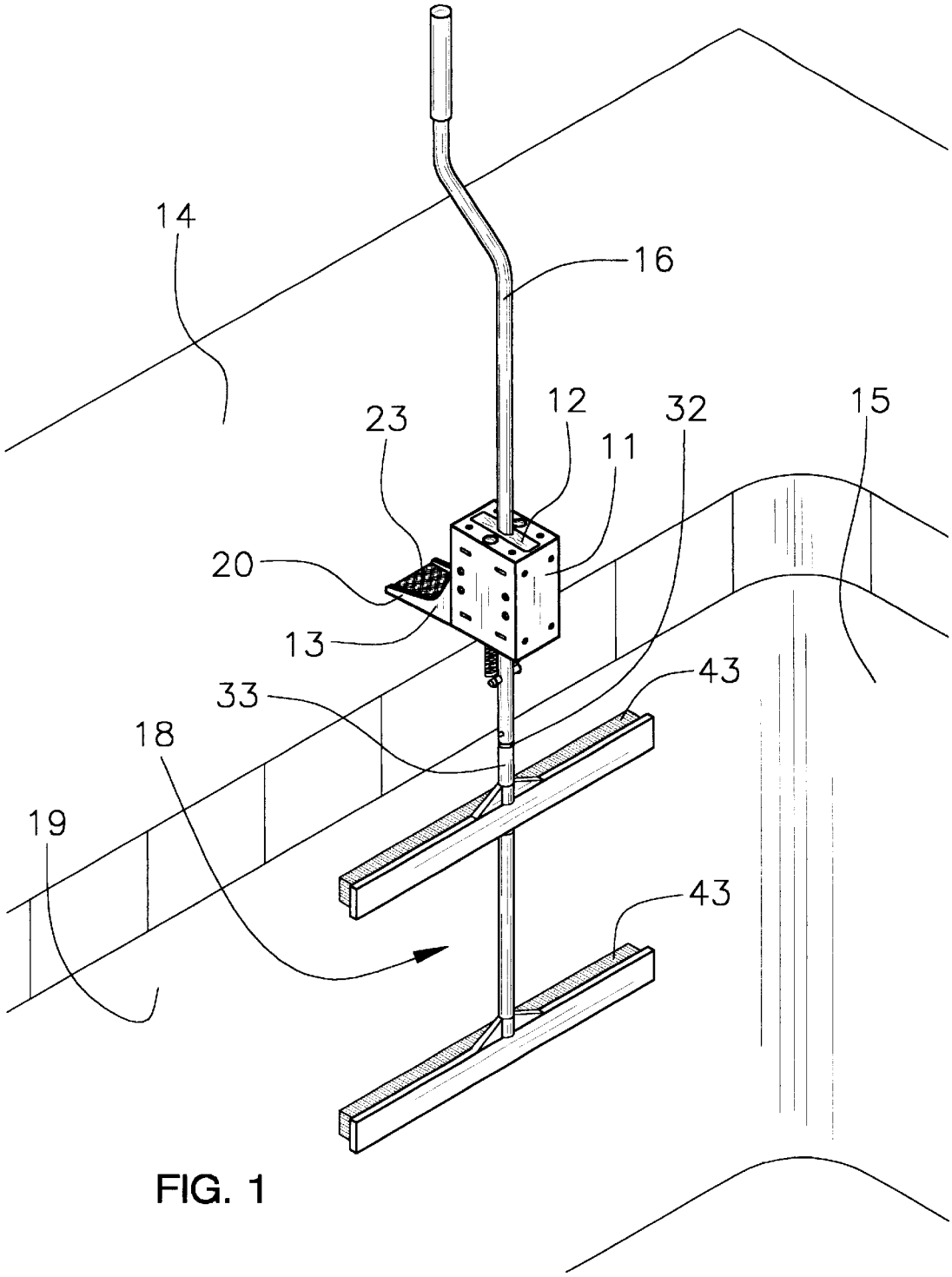
FIG. 1 is a perspective view of a new pool cleaning device according to the present invention.
Figure 2:
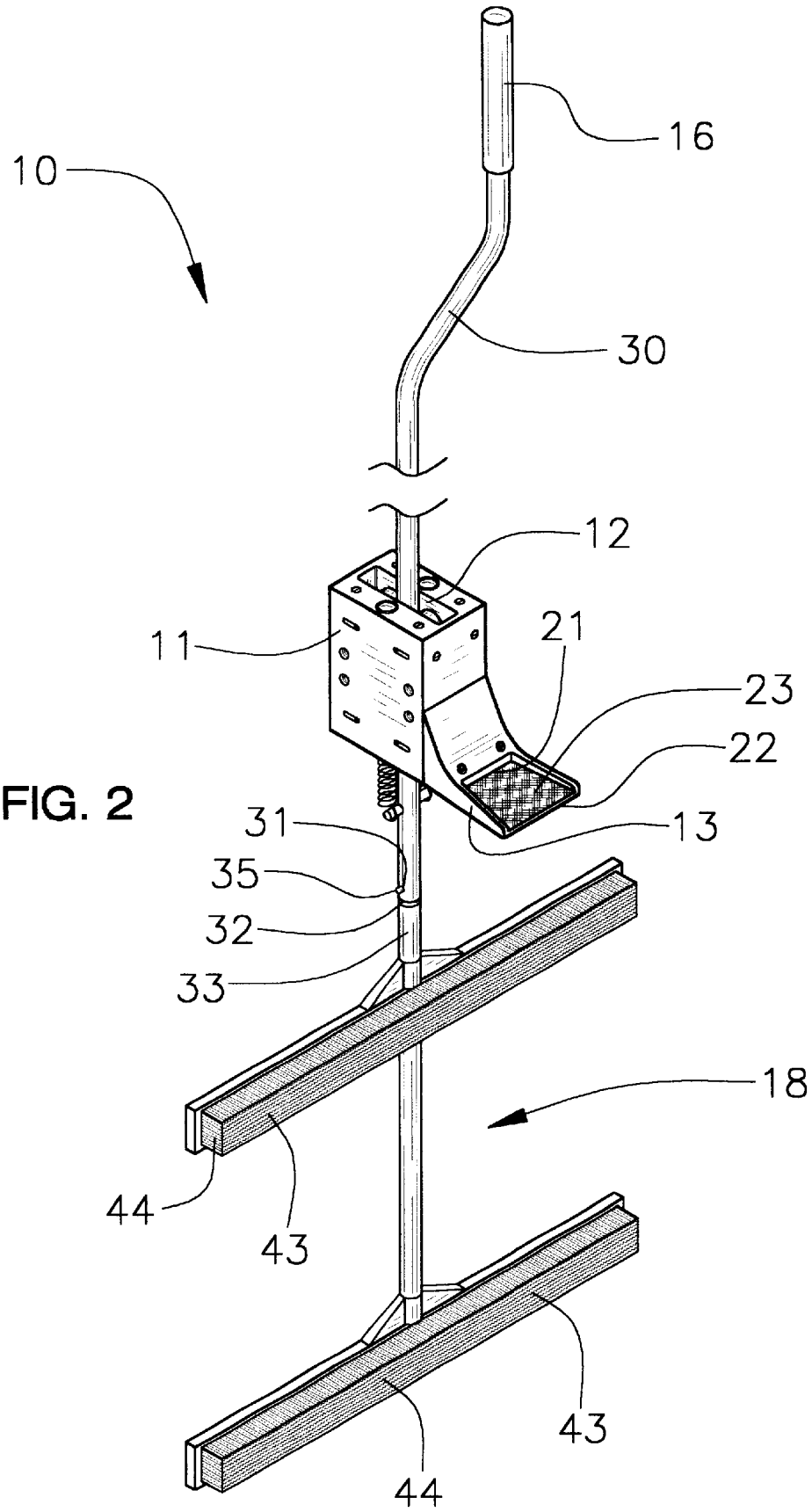
FIG. 2 is a perspective view of the present invention.
Figure 3:
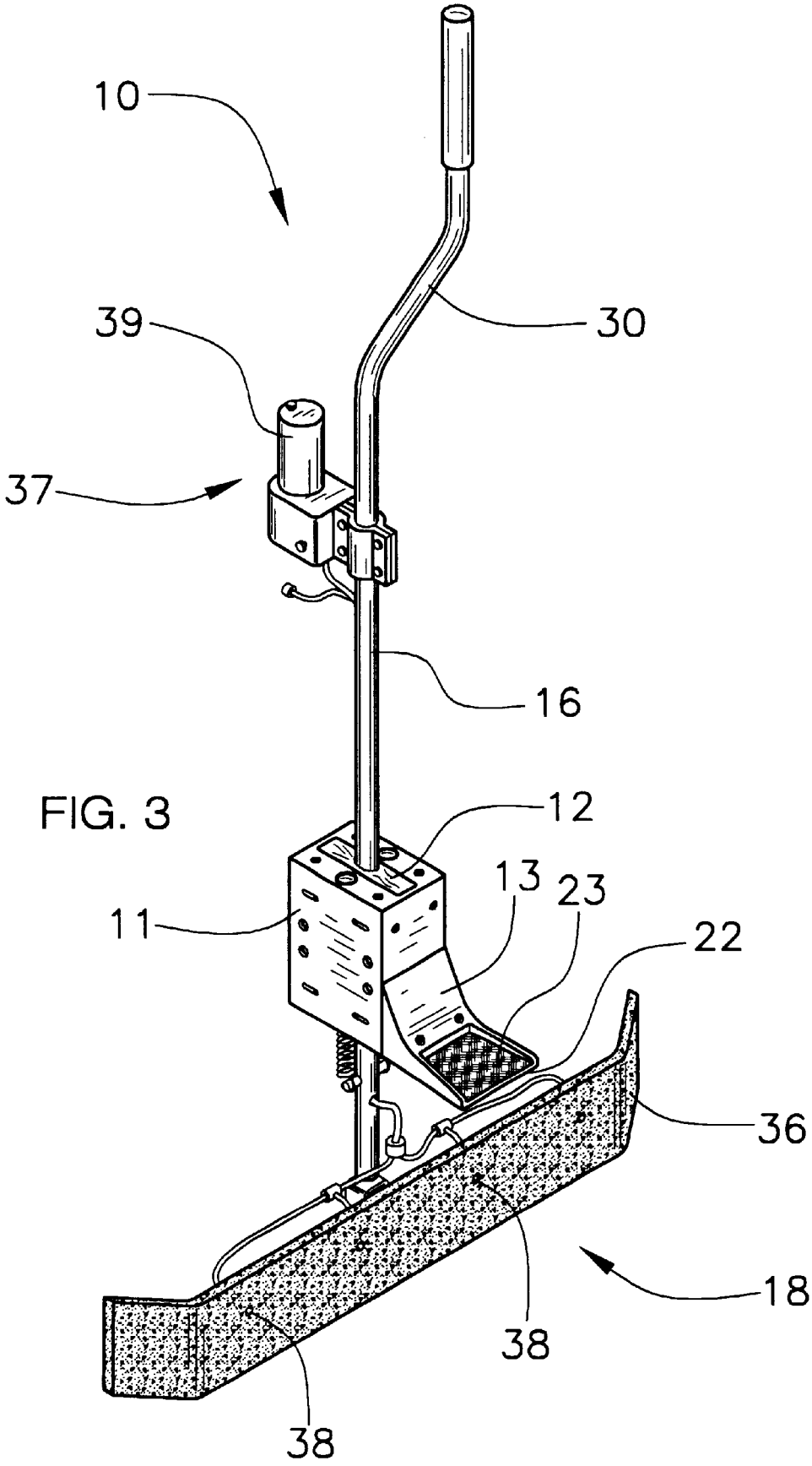
FIG. 3 is a perspective view of the present invention.

With reference now to the drawings, and in particular to FIGS. 1 through 5 thereof, a new pool cleaning device embodying the principles and concepts of the present invention and generally designated by the reference numeral 10 will be described.

As best illustrated in FIGS. 1 through 5, the pool cleaning device 10 generally includes a housing assembly 11 that has a base portion 12. The foot portion 13 is adapted for resting on a deck 14 of a pool 15. A handle member 16 slidably extends through the base portion 12 of the housing assembly 11. The handle member 16 is adapted to be gripped by hands of a user. The handle member 16 is linearly oscillatable along an axis of the handle member 16. A head assembly 18 is coupled to the handle member 16. The head assembly 18 is positioned below the housing assembly 11 such that the head assembly 18 engages the walls 19 of the pool 15. The head assembly 18 is adapted for facilitating cleaning of the walls 19 of the pool 15 when the handle member 16 is oscillated along the axis of the handle member 16.

The housing assembly 11 has support plate 20. The support plate 20 outwardly extends from the base portion 12 of the housing assembly 11. The support plate 20 is adapted for receiving a foot of the user. The support plate 20 is adapted for engaging the deck 14 of the pool 15 such that the support plate 20 supports the base portion 12 of the housing assembly 11 when the foot of the user engages the support plate 20 of the housing assembly 11.

The support plate 20 of the housing assembly 11 has a depression 21. The depression 21 extends into the support plate 20 from a leading edge 22 of the support plate 20. The depression 21 of the support plate 20 is adapted for receiving the foot of the user such that the depression 21 inhibits the foot of the user from slipping off of the support plate 20 when the handle member 16 is linearly oscillated. The support plate 20 of the housing assembly 11 has a pad 23. The pad 23 is positioned on an upper surface 24 of the support plate 20. The pad 23 of the support plate 20 is adapted for frictionally enhancing contact between the foot of the user and the support plate 20 such that the pad 23 inhibits the foot of the user from slipping off of the support plate 20 when the handle member 16 is linearly oscillated.

The base portion 12 of the housing assembly 11 has a plurality of rollers 25. The rollers 25 are positioned within a channel 26 of the base portion 12 of the housing assembly 11. Each of the rollers 25 engages a portion of the handle member 16 for extending through the base portion 12 of the housing assembly 11. The rollers 25 are for facilitating oscillating movement of the handle member 16 with respect to the housing assembly 11.

Each of the rollers 25 has a roller biasing member 27. The roller biasing member 27 is positioned between an associated one of the rollers 25 and a perimeter wall 28 of the base portion 12 of the housing assembly 11. The roller biasing member 27 of each of the rollers 25 is for biasing the associated one of the rollers 25 against the handle member 16 for facilitating oscillatory movement of the handle member 16.

The housing assembly 11 has a pair of handle biasing members 29. Each of the handle biasing members 29 is coupled between the base portion 12 of the housing assembly 11 and the handle member 16. The handle biasing member 29 is for biasing the handle member 16 upwards after the user has pushed the handle member 16 down.

The handle member 16 has an offset portion 30. The offset portion 30 is adapted to be gripped by the hands of the user. The offset portion 30 is offset such that the offset portion 30 is adapted for inhibiting the user from leaning over an edge of the pool 15 when the user is oscillating the handle member 16. The handle member 16 has a locking aperture 31. The locking aperture 31 is positioned proximate a lower end 32 of the handle member 16.

The head assembly 18 has a mounting member 33. The mounting member 33 of the head assembly 18 is received within a lumen 34 of the lower end 32 of the handle member 16. The mounting member 33 of the head assembly 18 has a locking pin 35. The locking pin 35 is biased outwardly from the mounting member 33. The locking pin 35 is adapted to be engaged by one of the hands of the user such that the locking pin 35 may be pressed flush with the mounting member 33 for facilitating insertion and removal of the mounting member 33 of the head assembly 18 from the lumen 34 of the handle member 16. The locking pin 35 is for engaging the locking aperture 31 of the handle member 16 for securing the head assembly 18 to the handle member 16 when the mounting member 33 of the head assembly 18 is inserted into the lumen 34 of the handle member 16.

The head assembly 18 includes a scrubbing member 36. The scrubbing member 36 is pivotally coupled to the mounting member 33. The scrubbing member 36 is adapted for scrubbing debris from the walls 19 of the pool 15 when the user oscillates the handle member 16. The scrubbing member 36 is pivotal with respect to the mounting member 33 when the scrubbing member 36 encounters changing angles of the walls 19 of the pool 15.

The head assembly 18 has a fluid containment assembly 37. The fluid containment assembly 37 is selectively coupled to the handle member 16. The fluid containment assembly 37 is in fluid communication with a plurality of ports 38 of the scrubbing member 36 such that the fluid containment assembly 37 is adapted for providing a cleaning liquid to the ports 38 of the scrubbing member 36. The ports 38 are adapted for applying the cleaning liquid to an engaging surface of the scrubbing member 36 such that the cleaning liquid facilitates removal of debris from the walls 19 of the pool 15 when the user oscillates the handle member 16.

The fluid containment assembly 37 includes a fluid container 39. The fluid container 39 is in fluid communication with the ports 38 of the scrubbing member 36. The fluid container 39 is adapted for holding cleaning fluid such that the fluid container 39 provides the cleaning fluid to the ports 38 of the scrubbing member 36 when the scrubbing member 36 is used for cleaning the walls 19 of the pool 15. The fluid containment assembly 37 includes fluid conduit 40. The fluid conduit 40 is coupled between the fluid container 39 and ports 38 of the scrubbing member 36. The fluid conduit 40 is adapted for permitting fluid communication between the fluid container 39 and the ports 38 of the scrubbing member 36.

The fluid conduit 40 of the fluid containment assembly 37 has a bypass portion 41. The bypass portion 41 is adapted for permitting the user to flush the cleaning liquid from the fluid conduit 40 when the user has finished using the scrubbing member 36.

The fluid containment assembly 37 has a valve 42. The valve 42 is in fluid communication between the fluid container 39 and the ports 38 of the scrubbing member 36. The valve 42 controls fluid communication between the fluid container 39 and the ports 38 of the scrubbing member 36.

In an alternate embodiment the head assembly 18 includes a mounting member 33 and at least one brush member 43. The brush member 43 is coupled to the mounting member 33. The mounting member 33 is coupled to the handle member 16. The brush member 43 has a plurality of bristles 44. The bristles 44 of the brush member 43 is adapted for engaging the surface of the wall 19 of the pool 15 such that the bristles 44 are for scrubbing debris from the walls 19 of the pool 15 when the handle member 16 is oscillated by the user.

In use, a user would add a predetermined type of cleaning fluid to the applicator bottle and attach one or two brushes, sponges, or other cleaning devices to the bottom of the pole. The user would position the tool along the pool edge with his foot stabilizing it in place. He could then guide the brushes along the pool walls of sides by moving the handle up and down through the rollers and spring mechanisms in the housing. To apply cleaning chemical directly to stains, the user would only need to adjust the check valve. The user could thereafter scrub the area with the brush and cleaning materials, as they safely stand on the pool deck.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool cleaning device for cleaning walls of a pool, the pool cleaning device comprising:

a housing assembly having a base portion, a foot portion being adapted for resting on a deck of a pool;

a handle member slidably extending through said base portion of said housing assembly, said handle member being adapted for being gripped by hands of a user, said handle member being linearly oscillatable along an axis of said handle member;

a head assembly being coupled to said handle member, said head assembly being positioned below said housing assembly such that said head assembly engages the walls of the pool, said head assembly being adapted for facilitating cleaning of the walls of the pool when said handle member is oscillated along said axis of said handle member; and said housing assembly having support plate, said support plate outwardly extending from said base portion of said housing assembly, said support plate being adapted for receiving a foot of the user, said support plate being adapted for engaging the deck of the pool such that said base portion of said housing assembly is supported by said support plate when the foot of the user engages said support plate of said housing assembly.

2. The pool cleaning device as set forth in claim 1, further comprising:

said support plate of said housing assembly having a depression, said depression extending into said support plate from a leading edge of said support plate, said depression of said support plate being adapted for receiving the foot of the user such that said depression inhibits the foot of the user from slipping off of said support plate when said handle member is linearly oscillated.

3. The pool cleaning device as set forth in claim 1, further comprising:

said support plate of said housing assembly having a pad, said pad being positioned on an upper surface of said support plate, said pad of said support plate being adapted for frictionally enhancing contact between the foot of the user and said support plate such that said pad inhibits the foot of the user from slipping off of said support plate when said handle member is linearly oscillated;

said base portion of said housing assembly having a plurality of rollers, said rollers being positioned within a channel of said base portion of said housing, each of said rollers engaging a portion of said handle member extending through said base portion of said housing, said rollers being for facilitating oscillating movement of said handle member with respect to said housing assembly.

4. The pool cleaning device as set forth in claim 1, further comprising:

said base portion of said housing assembly having a plurality of rollers, said rollers being positioned within a channel of said base portion of said housing, each of said rollers, engaging a portion of said handle member extending through said base portion of said housing, said rollers being for facilitating oscillating movement of said handle member with respect to said housing assembly.

5. The pool cleaning device as set forth in claim 4, further comprising:

each of said rollers having a roller biasing member, said roller biasing member being positioned between an associated one of said rollers and a perimeter wall of said base portion of said housing assembly, said roller biasing member of each of said rollers being for biasing the associated one of said rollers against said handle member for facilitating, oscillatory movement of said handle member.

6. The pool cleaning device as set forth in claim 1, further comprising:

said housing assembly having a pair of handle biasing members, each of said handle biasing members being coupled between said base portion of said housing assembly and said handle member, said handle biasing member being for biasing said handle member upwards after the user has pushed said handle member down.

7. The pool cleaning device as set forth in claim 1, further comprising:

said handle member having an offset portion, said offset portion being adapted for being gripped by the hands of the user, said offset portion being offset such that said offset portion is adapted for inhibiting the user from leaning over an edge of the pool when the user is oscillating the handle member.

8. The pool cleaning device as set forth in claim 1, further comprising:

said handle member having a locking aperture, said locking aperture being positioned proximate a lower end of said handle member;

said head assembly having a mounting member, said mounting member of said head assembly being received within a lumen of said lower end of said handle member, said mounting member of said head assembly having a locking pin, said locking pin being biased outwardly from said mounting member, said locking pin being adapted for being engaged by one of the hands of the user such that said locking pin may be pressed flush with said mounting member for facilitating insertion and removal of said mounting member of said head assembly from said lumen of said handle member, said locking pin being for engaging said locking aperture of said handle member for securing said head assembly to said handle member when said mounting member of said head assembly is inserted into said lumen of said handle member.

9. The pool cleaning device as set forth in claim 1, further comprising:

said head assembly comprising a mounting member and at least one brush member, said brush member being coupled to said mounting member, said mounting member being coupled to said handle member, said brush member having a plurality of bristles, said bristles of said brush member being adapted for engaging the surface of the wall of the pool such that said bristles are for scrubbing debris from the walls of the pool when said handle member is oscillated by the user.

10. The pool cleaning device as set forth in claim 9, further comprising:

said head assembly comprising a pair of brush members, each of said brush member being coupled to said mounting member, each of said brush members having a plurality of bristles, said bristles of each of said brush members being adapted for engaging the surface of the wall of the pool such that said bristles are for scrubbing debris from the walls of the pool when said handle member is oscillated by the user.

11. The pool cleaning device as set forth in claim 1, further comprising:

said head assembly comprising scrubbing member and a mounting member, said scrubbing member being pivotally coupled to said mounting member, said scrubbing member being adapted for scrubbing debris from the walls of the pool when said handle member is oscillated by the user, said scrubbing member being pivotal with respect to said mounting member when said scrubbing member encounters changing angles of the walls of the pool.

12. The pool cleaning device as set forth in claim 11, further comprising:

said head assembly having a fluid containment assembly, said fluid containment assembly being selectively coupled to said handle member, said fluid containment assembly being in fluid communication with a plurality of ports of said scrubbing member such that said fluid containment assembly is adapted for providing a cleaning liquid to said ports of said scrubbing member, said ports being adapted for applying the cleaning liquid to an engaging surface of said scrubbing member such that the cleaning liquid facilitates removal of debris from the walls of the pool when said handle member is oscillated by the user.

13. The pool cleaning device as set forth in claim 12, further comprising:

said fluid containment assembly comprising a fluid container, said fluid container being in fluid communication with said ports of said scrubbing member, said fluid container being adapted for holding cleaning fluid such that said fluid container provides the cleaning fluid to said ports of said scrubbing member when said scrubbing member is used for cleaning the walls of the pool.

14. The pool cleaning device as set forth in claim 13, further comprising:

said fluid containment assembly comprising fluid conduit, said fluid conduit being coupled between said fluid container and ports of said scrubbing member, said fluid conduit being adapted for permitting fluid communication between said fluid container and said ports of said scrubbing member.

15. The pool cleaning device as set forth in claim 14, further comprising:

said fluid conduit of said fluid containment assembly having a bypass portion, said bypass portion being adapted for permitting the user to flush the cleaning liquid from said fluid conduit when the user has finished using said scrubbing member.

16. The pool cleaning device as set forth in claim 13, further comprising:

said fluid containment assembly having a valve, said valve being in fluid communication between said fluid container and said ports of said scrubbing member, said valve controlling fluid communication between said fluid container and said ports of said scrubbing member.

17. The pool cleaning device as set forth in claim 1, further comprising:

wherein said support plate of said housing assembly having a depression, said depression extending into said support plate from a leading edge of said support plate, said depression of said support plate being adapted for receiving the foot of the user such that said depression inhibits the foot of the user from slipping off of said support plate when said handle member is linearly oscillated;

wherein said support plate of said housing assembly having a pad, said pad being positioned on an upper surface of said support plate, said pad of said support plate being adapted for frictionally enhancing contact between the foot of the user and said support plate such that said pad inhibits the foot of the user from slipping off of said support plate when said handle member is linearly oscillated;

wherein said base portion of said housing assembly having a plurality of rollers, said rollers being positioned within a channel of said base portion of said housing, each of said rollers engaging a portion of said handle member extending through said base portion of said housing, said rollers being for facilitating oscillating movement of said handle member with respect to said housing assembly;

wherein each of said rollers having a roller biasing member, said roller biasing member being positioned between an associated one of said rollers and a perimeter wall of said base portion of said housing assembly, said roller biasing member of each of said rollers being for biasing the associated one of said rollers against said handle member for facilitating oscillatory movement of said handle member;

wherein said housing assembly having a pair of handle biasing members, each of said handle biasing members being coupled between said base portion of said housing assembly and said handle member, said handle biasing member being for biasing said handle member upwards after the user has pushed said handle member down;

wherein said handle member having an offset portion, said offset portion being adapted for being gripped by the hands of the user, said offset portion being offset such that said offset portion is adapted for inhibiting the user from leaning over an edge of the pool when the user is oscillating the handle member;

wherein said handle member having a locking aperture, said locking aperture being positioned proximate a lower end of said handle member;

said head assembly having a mounting member, said mounting member of said head assembly being received within a lumen of said lower end of said handle member, said mounting member of said head assembly having a locking pin, said locking pin being biased outwardly from said mounting member, said locking pin being adapted for being engaged by one of the hands of the user such that said locking pin may be pressed flush with said mounting member for facilitating insertion and removal of said mounting member of said head assembly from said lumen of said handle member, said locking pin being for engaging said locking aperture of said handle member for securing said head assembly to said handle member when said mounting member of said head assembly is inserted into said lumen of said handle member;

wherein said head assembly comprising a scrubbing member, said scrubbing member being pivotally coupled to said mounting member, said scrubbing member being adapted for scrubbing debris from the walls of the pool when said handle member is oscillated by the user, said scrubbing member being pivotal with respect to said mounting member when said scrubbing member encounters changing angles of the walls of the pool;

wherein said head assembly having a fluid containment assembly, said fluid containment assembly being selectively coupled to said handle member, said fluid containment assembly being in fluid communication with a plurality of ports of said scrubbing member such that said fluid containment assembly is adapted for providing a cleaning liquid to said ports of said scrubbing member, said ports being adapted for applying the cleaning liquid to an engaging surface of said scrubbing member such that the cleaning liquid facilitates removal of debris from the walls of the pool when said handle member is oscillated by the user;

wherein said fluid containment assembly comprising a fluid container, said fluid container being in fluid communication with said ports of said scrubbing member, said fluid container being adapted for holding cleaning fluid such that said fluid container provides the cleaning fluid to said ports of said scrubbing member when said scrubbing member is used for cleaning the walls of the pool;

wherein said fluid containment assembly comprising fluid conduit, said fluid conduit being coupled between said fluid container and ports of said scrubbing member, said fluid conduit being adapted for permitting fluid communication between said fluid container and said ports of said scrubbing member;

wherein said fluid conduit of said fluid containment assembly having a bypass portion, said bypass portion being adapted for permitting the user to flush the cleaning liquid from said fluid conduit when the user has finished using said scrubbing member;

wherein said fluid containment assembly having a valve, said valve being in fluid communication between said fluid container and said ports of said scrubbing member, said valve controlling fluid communication between said fluid container and said ports of said scrubbing member.

18. A pool cleaning device for cleaning walls of a pool, the pool cleaning device comprising:

a housing assembly having a base portion, a foot portion being adapted for resting on a deck of a pool;

a handle member slidably extending through said base portion of said housing assembly, said handle member being adapted for being gripped by hands of a user, said handle member being linearly oscillatable along an axis of said handle member;

a head assembly being coupled to said handle member, said head assembly being positioned below said housing assembly such that said head assembly engages the walls of the pool, said head assembly being adapted for facilitating cleaning of the walls of the pool when said handle member is oscillated along said axis of said handle member; and said base portion of said housing assembly having a plurality of rollers, said rollers being positioned within a channel of said base portion of said housing, each of said rollers engaging a portion of said handle member extending through said base portion of said housing, said rollers being for facilitating oscillating movement of said handle member with respect to said housing assembly.

19. A pool cleaning device for cleaning walls of a pool, the pool cleaning device comprising:

a housing assembly having a base portion, a foot portion being adapted for resting on a deck of a pool;

a handle member slidably extending through said base portion of said housing assembly, said handle member being adapted for being gripped by hands of a user, said handle member being linearly oscillatable along an axis of said handle member;

a head assembly being coupled to said handle member, said head assembly being positioned below said housing assembly such that said head assembly engages the walls of the pool, said head assembly being adapted for facilitating cleaning of the walls of the pool when said handle member is oscillated along said axis of said handle member; and said housing assembly having a pair of handle biasing members, each of said handle biasing members being coupled between said base portion of said housing assembly and said handle member, said handle biasing member being for biasing said handle member upwards after the user has pushed said handle member down.

20. A pool cleaning device for cleaning walls of a pool, the pool cleaning device comprising:

a housing assembly having a base portion, a foot portion being adapted for resting on a deck of a pool;

a handle member slidably extending through said base portion of said housing assembly, said handle member being adapted for being gripped by hands of a user, said handle member being linearly oscillatable along an axis of said handle member;

a head assembly being coupled to said handle member, said head assembly being positioned below said housing assembly such that said head assembly engages the walls of the pool, said head assembly being adapted for facilitating cleaning of the walls of the pool when said handle member is oscillated along said axis of said handle member;

said handle member having a locking aperture, said locking aperture being positioned proximate a lower end of said handle member; and said head assembly having a mounting member, said mounting member of said head assembly being received within a lumen of said lower end of said handle member, said mounting member of said head assembly having a locking pin, said locking pin being biased outwardly from said mounting member, said locking pin being adapted for being engaged by one of the hands of the user such that said locking pin may be pressed flush with said mounting member for facilitating insertion and removal of said mounting member of said head assembly from said lumen of said handle member, said locking pin being for engaging said locking aperture of said handle member for securing said head assembly to said handle member when said mounting member of said head assembly is inserted into said lumen of said handle member.

21. A pool cleaning device for cleaning walls of a pool, the pool cleaning device comprising:

a housing assembly having a base portion, a foot portion being adapted for resting on a deck of a pool;

a handle member slidably extending through said base portion of said housing assembly, said handle member being adapted for being gripped by hands of a user, said handle member being linearly oscillatable along an axis of said handle member;

a head assembly being coupled to said handle member, said head assembly being positioned below said housing assembly such that said head assembly engages the walls of the pool, said head assembly being adapted for facilitating cleaning of the walls of the pool when said handle member is oscillated along said axis of said handle member; and said head assembly comprising a mounting member and at least one brush member, said brush member being coupled to said mounting member, said mounting member being coupled to said handle member, said brush member having a plurality of bristles, said bristles of said brush member being adapted for engaging the surface of the wall of the pool such that said bristles are for scrubbing debris from the walls of the pool when said handle member is oscillated by the user.

22. A pool cleaning device for cleaning walls of a pool, the pool cleaning device comprising:

a housing assembly having a base portion, a foot portion being adapted for resting on a deck of a pool;

a handle member slidably extending through said base portion of said housing assembly, said handle member being adapted for being gripped by hands of a user, said handle member being linearly oscillatable along an axis of said handle member;

a head assembly being coupled to said handle member, said head assembly being positioned below said housing assembly such that said head assembly engages the walls of the pool, said head assembly being adapted for facilitating cleaning of the walls of the pool when said handle member is oscillated along said axis of said handle member; and said head assembly comprising scrubbing member and a mounting member, said scrubbing member being pivotally coupled to said mounting member, said scrubbing member being adapted for scrubbing debris from the walls of the pool when said handle member is oscillated by the user, said scrubbing member being pivotal with respect to said mounting member when said scrubbing member encounters changing angles of the walls of the pool.

* * * * *